US006072271A

United States Patent [19]

Pontaillier et al.

[11] Patent Number: 6,072,271

[45] Date of Patent: Jun. 6, 2000

[54] INLINE ELECTRON GUN HAVING IMPROVED BEAM FORMING REGION

[75] Inventors: Yves Pontaillier, Montmancon; Rodolphe Lauzier, Dijon, both of France

[73] Assignee: Thomson Tubes and Display, S.A., Boulogne Cedex, France

[21] Appl. No.: 08/432,442

[22] Filed: May 1, 1995

[30] Foreign Application Priority Data

Aug. 26, 1994 [FR] France ..... 94 10312

[51] Int. Cl.[7] ..... H01J 29/46; H01J 29/56

[52] U.S. Cl. ..... 313/414; 313/447; 315/14

[58] Field of Search ..... 313/447, 412, 313/413, 414; 315/14, 15

[56] References Cited

U.S. PATENT DOCUMENTS

| | | | |
|---|---|---|---|
| 3,767,953 | 10/1973 | Bossers | 313/86 |
| 4,234,814 | 11/1980 | Chen et al. | 313/412 |
| 4,242,613 | 12/1980 | Brambring et al. | 313/447 |
| 4,319,163 | 3/1982 | Chen | 315/14 |
| 4,990,822 | 2/1991 | Guzowski et al. | 313/414 |
| 5,023,508 | 6/1991 | Park | 313/414 |

FOREIGN PATENT DOCUMENTS

| | | | |
|---|---|---|---|
| 0183558 | 6/1986 | European Pat. Off. | H01J 29/50 |
| 0276952 | 8/1988 | European Pat. Off. | H01J 29/50 |
| 2435808 | 9/1979 | France | H01J 29/46 |
| 2020092 | 11/1979 | United Kingdom | H01J 29/46 |

OTHER PUBLICATIONS

Patent Abstracts of Japan, vol. 005,No. 063 (E–054), Apr. 28 1981, & JP–A–56 013643 (Hitachi Ltd.), Feb. 10 1981, (Only Abstract Enclosed).

*Primary Examiner*—Michael H. Day
*Attorney, Agent, or Firm*—Joseph S. Tripoli; Dennis H. Irlbeck

[57] ABSTRACT

An improved inline electron gun includes a plurality of electrodes spaced from three cathodes in the direction of a longitudinal axis of the gun. The electrodes form at least a beam forming region and a main focus lens in the paths of three electron beams, a center beam and two side beams. Each of the electrodes includes three inline apertures therein for passage of the three electron beams. The beam forming region includes the cathodes and three consecutive electrodes, a G1 electrode, a G2 electrode and a G3 electrode. The improvement comprises the G2 electrode having two linear projections on either side of the inline apertures therein. The projections parallel the inline direction of the apertures protrude in a direction parallel to the longitudinal axis, past the apertured portion of the G3 electrode in overlapping relationship therewith. On the side of the G3 electrode facing the G2 electrode, the G3 electrode has two linear channels therein on either side of the inline apertures therein. The channels are immediately adjacent the projections on the G2 electrode and in a spaced nested relationship therewith.

1 Claim, 2 Drawing Sheets

INLINE ELECTRON GUN HAVING IMPROVED BEAM FORMING REGION

The present invention relates to inline electron guns such as used in color picture tubes, and particularly to such guns having improved structures in their beam forming regions.

BACKGROUND OF THE INVENTION

An inline electron gun is one designed to generate or initiate preferably three electron beams in a common plane and to direct those beams along convergent paths to a point or small area of convergence near the tube screen. Inline electron guns all have a beam forming region and a main focus lens and may also include a prefocus lens. The beam forming region usually comprises the cathodes and three consecutive electrodes. A prefocus lens may comprise two or three electrodes. The main focusing lens is usually formed by two spaced electrodes.

Usually, the second electrode from the cathodes, called the G2 electrode, is plate-shaped. Such plate shape makes the G2 electrode subject to bending and flexing during electron gun operation. It is known to put small beads in the G2 electrodes to reinforce them. However, even with such reinforcement, these G2 electrodes still exhibit some flexing during gun operation.

Another problem that occurs in electron guns is arcing which may occur between the second and third electrodes from the cathodes (the G2 and G3 electrodes). Such arcing is enhanced when one of the electrodes has a protrusion on it that faces the other electrode.

The present invention addresses these problems by providing an improved construction for the beam forming region in an inline electron gun.

SUMMARY OF THE INVENTION

An improved inline electron gun includes a plurality of electrodes, spaced from three cathodes, in a direction of a longitudinal axis of the gun. The electrodes form at least a beam forming region and a main focus lens in the paths of three electron beams, a center beam and two side beams. Each of the electrodes includes three inline apertures therein for passage of the three electron beams. The beam forming region includes the cathodes and three consecutive electrodes, a G1 electrode, a G2 electrode and a G3 electrode. The improvement comprises the G2 electrode having two linear projections on either side of the inline apertures therein and parallel to the inline direction of the apertures. The projections protrude in a direction parallel to the longitudinal axis, past the apertured portion of the G3 electrode in overlapping relationship therewith. On the side of the G3 electrode facing the G2 electrode, the G3 electrode has two linear channels therein on either side of the inline apertures therein. The channels are immediately adjacent the projections on the G2 electrode and in a spaced nested relationship therewith. This improvement provides a stiffer G2 electrode, and, by modifying the G3 electrode, it minimizes a possible cause of arcing that may be created by the improvement in the G2 electrode.

DETAILED DESCRIPTION OF THE PREFERRED EMBODIMENT

Figure 1:
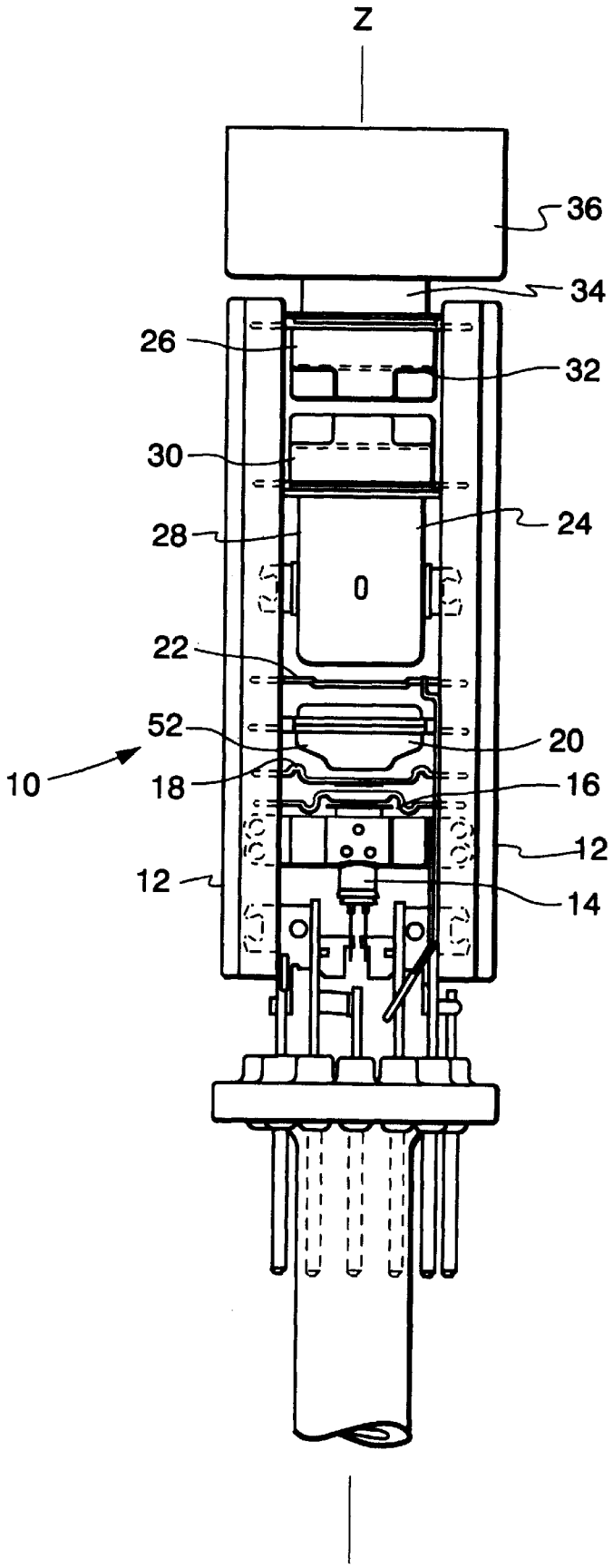
FIG. 1 is a side view of an electron gun incorporating an embodiment of the present invention.

In detail, an electron gun 10, shown in FIG. 1, comprises two insulative support rods 12 on which various electrodes are mounted. These electrodes include three spaced coplanar cathodes 14 (one shown), a control grid electrode 16 (G1), a screen grid electrode 18 (G2), a first prefocus electrode 20 (G3), a second prefocus electrode 22 (G4), a combined third prefocus electrode and first main focus electrode 24 (G5) and a second main focus electrode 26 (G6), spaced along the support rods 12 in the order named and in the direction of a longitudinal axis Z. Each of the G1 through G6 electrodes has three inline apertures therein, or at each end thereof, to permit passage of three coplanar electron beams. The main electrostatic focusing lens in the gun 10 is formed between the G5 electrode 24 and the G6 electrode 26. The G5 electrode 24 also may be referred to as the focus electrode, because a focus voltage is applied to it, and the G6 electrode 26 may be referred to as the anode electrode, because an anode voltage is applied to it. The G5 electrode 24 is formed from two cup-shaped elements, 28 and 30, that are connected at their open ends. The G6 electrode 26 is formed from two cup-shaped elements, 32 and 34, that also are connected at their open ends. A shield cup 36 is attached to the element 34 at the exit of the electron gun.

All of the electrodes of the electron gun 10 are either directly or indirectly attached to the two insulative support rods 12. The rods may extend to and support the G1 electrode 16 and the G2 electrode 18, or these two electrodes may be attached to the G3 electrode 20 by some other insulative means. Preferably, the support rods are of glass which has been heated and pressed onto claws extending from the electrodes, to embed the claws in the rods.

The G3 electrode 20 is constructed from two cup-shaped parts that are attached at their open ends. One part forms a portion of the beam forming region of the gun, and the other part forms part of the prefocus lens of the gun.

Figure 2:
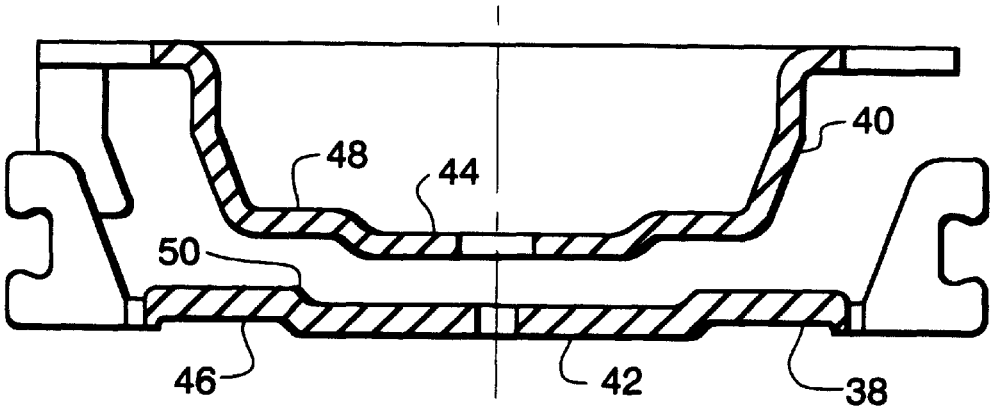
Fig. 2 PRIOR ART
FIG. 2 is a cross-sectional side view of a prior art G2 electrode and a facing portion of a prior art G3 electrode.

FIG. 2 shows a prior art G2 electrode 38 and a facing side of a prior art G3 electrode 40. The closest spacing between these electrodes is between the apertured portion 42 of the G2 electrode 38 and the apertured portion 44 of the G3 electrode 40. Outward from the apertured portions, an intermediate portion 46 of the G2 electrode 38 is spaced from an intermediate portion 48 of the G3 electrode 40 a distance only slightly greater than the closest spacing between these electrodes.

For example, in one prior art embodiment, the closest spacing at the apertured portions is 0.76 mm, the spacing between the nearest surfaces of the intermediate portions is 0.89 mm, and the spacing between a point 50 on the intermediate portion 46 to the G3 electrode 40 is 1.08 mm.

Figure 3:
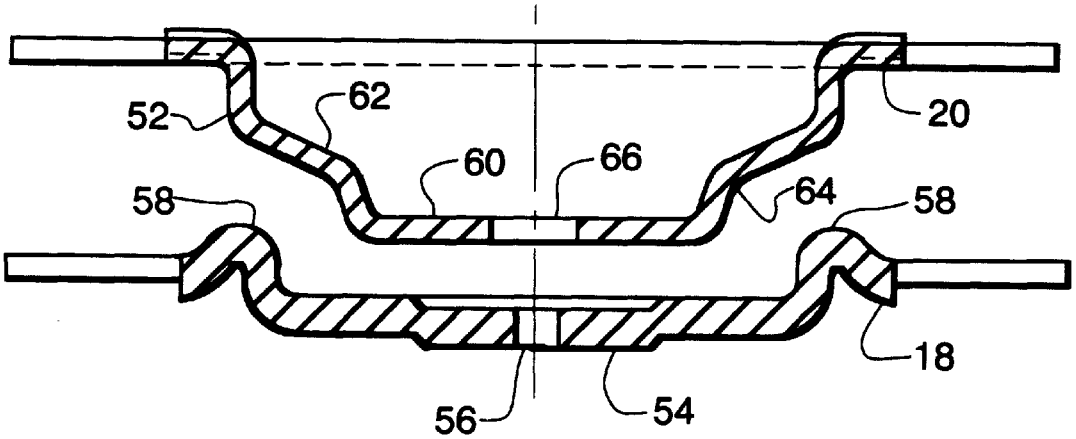
FIG. 3 is a cross-sectional side view of the novel G2 electrode and facing portion of the novel G3 electrode of FIG. 1.

FIG. 3 shows the G2 electrode 18 and a facing side 52 of the G3 electrode 20, constructed in accordance with the present invention. The G2 electrode 18 includes an apertured portion 54, having three inline apertures 56 (one shown), and two linear projections 58 therein on either side of the inline apertures 56. The projections 58 parallel each other and the inline direction of the inline apertures 56. Both of the projections 58 protrude in a direction parallel to the longitudinal axis Z of the electron gun 10 past an apertured portion 60 of the G3 electrode 20, thereby somewhat overlapping the G3 electrode 20 in the longitudinal axis Z direction. The inclusion of the two linear projections 58 on the G2 electrode 18 greatly improves the stiffness of the electrode. However, because of the addition of the two large linear projections on the G2 electrode 18, there is an increased possibility of the projections forming arcing sights if no further changes are made. To reduce this risk of arcing between the G2 electrode and the G3 electrode, the spacings between the projections and all points on the G3 electrode are increased by redesigning the shape of the G3 electrode.

The G3 electrode 20 includes an intermediate portion 62 that is inclined at a greater angle with respect to the apertured portion 60 than is the prior art intermediate portion 48 with respect to the apertured portion 44, and that is curved to form two linear channels 64 therein on either side of the inline apertures 66 in the apertured portion 60. The channels 64 are immediately adjacent the projections 58 on the electrode 18 and in a spaced nested relationship therewith.

In a preferred embodiment of the present invention, the spacing between the two apertured portions, 54 and 60, of the G2 and G3 electrodes, respectively, is 1.067 mm, and the nearest spacing between a projection 58 and a channel 64 is 1.261 mm. This is a substantial improvement in difference in spacing between peripheral portions of the G2 and G3 electrodes compared to the prior art embodiment of FIG. 2, which does not include any large projections. Furthermore, because there is an overlap of the projections on the G2 electrode with the apertured portion of the G3 electrode, the linear projections may also protect the area between the G2 and G3 from any stray vertically extending magnetic fields that may pass through this area of the electron gun.

What is claimed is:

1. In an inline electron gun, including a plurality of electrodes spaced from three cathodes in a direction of a longitudinal axis of said gun, said electrodes forming at least a beam forming region and a main focus lens in the paths of three electron beams, a center beam and two side beams, each of said electrodes including three inline apertures therein for passage of said three electron beams, and said beam forming region including said cathodes and three consecutive electrodes, a G1 electrode, a G2 electrode and a G3 electrode, the improvement comprising said G2 electrode having two linear projections therein on either side of the inline apertures therein, said projections paralleling the inline direction of said apertures and protruding in a direction parallel to said longitudinal axis past an apertured portion of said G3 electrode in overlapping relationship therewith, on the side of said G3 electrode facing said G2 electrode, said G3 electrode having two linear channels therein on either side of the inline apertures therein, said channels being immediately adjacent said projections on said G2 electrode and in a spaced nested relationship therewith, and including the distance between each one of said projections of said G2 electrode to the immediately adjacent one of said channels of said G3 electrode being approximately 30% to 50% greater than the distance between said G2 electrode and said G3 electrode at the respective apertured portions thereof containing respective ones of said inline apertures.

* * * * *